United States Patent [19]

Andersson

[11] Patent Number: 4,921,021

[45] Date of Patent: May 1, 1990

[54] FILLER PIPE FOR A PACKING MACHINE

[75] Inventor: Sven A. Andersson, Veberoed, Sweden

[73] Assignee: AB Tetra Pak, Lund, Sweden

[21] Appl. No.: 289,193

[22] Filed: Dec. 23, 1988

[30] Foreign Application Priority Data

Dec. 23, 1987 [JP] Japan ..... 62-195655[U]

[51] Int. Cl.[5] ..... B65B 3/10

[52] U.S. Cl. ..... 141/103; 141/100; 141/234; 141/244; 53/237; 53/553; 53/559

[58] Field of Search ..... 141/35, 36, 100–103, 141/236–240, 244, 104, 105, 241–243, 246, 234, 235, 248; 239/549, 546; 53/559, 154, 553, 554, 237, 240; 222/129

[56] References Cited

U.S. PATENT DOCUMENTS

| | | | |
|---|---|---|---|
| 682,243 | 9/1901 | Cuscaden et al. | 53/237 |
| 2,201,545 | 5/1940 | Mazzanobile | 141/100 |
| 2,919,836 | 1/1960 | Limpert | 222/129 |
| 3,129,673 | 4/1964 | Stanley et al. | 141/100 |
| 3,166,107 | 9/1965 | Swenson et al. | 141/236 |
| 3,324,905 | 6/1967 | Paulo | 141/100 |
| 3,952,782 | 4/1976 | Mannara | 141/100 |
| 4,017,247 | 4/1977 | Soukup et al. | 53/559 |
| 4,151,698 | 5/1979 | Muller et al. | 53/240 |
| 4,191,101 | 3/1980 | Ogawa et al. | 141/100 |
| 4,222,417 | 9/1980 | Andersson | 141/392 |

*Primary Examiner*—Henry J. Recla
*Assistant Examiner*—Casey Jacyna
*Attorney, Agent, or Firm*—Koda & Androlia

[57] ABSTRACT

A filler pipe for a packing machine for consecutively filling a traveling and continuous series of connected packing container blanks, with a liquid product such as yogurt, and a separate jam product, without mixing the two types of product. This filler pipe is used in conjunction with blanks formed of two joined webs and provides sealing of the filled packing containers. The invention utilizes a nozzle with multiple filling paths each of which passes product to at least one of the packing container blanks. The nozzle receives the liquid product from a flat shaped larger delivery pipe, and the jam product from a smaller delivery pipe parallel to the larger pipe. The smaller pipe, which may be located inside or on the outer wall of the large pipe, is placed at a predetermined distance above the junction of the larger delivery pipe and the nozzle. In this way each container is first filled with its share of jam product and then with the liquid (yogurt) product with no mixing of the two products. This invention represents an advance over existing packing methods which can only supply mixed products.

2 Claims, 2 Drawing Sheets

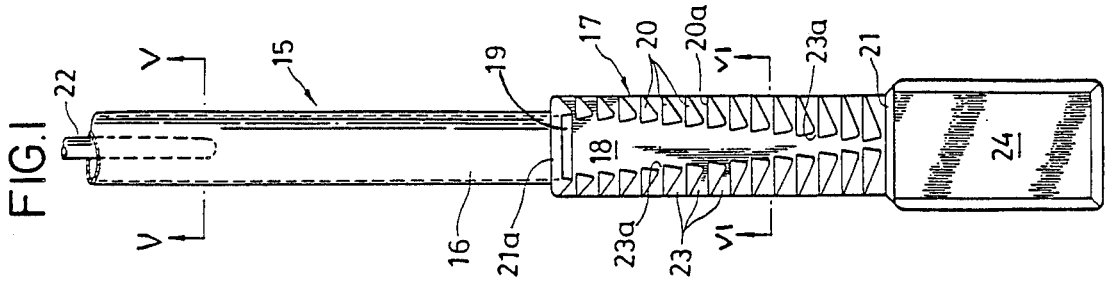
FIG.1
22
V
15
19
17
20
20a
V1
23a
21
18
24
16
21a
23a
23
V1
V
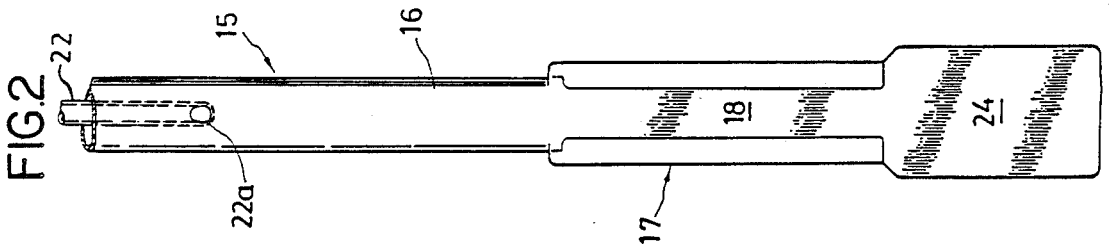
FIG.2
22
15
16
18
24
22a
17
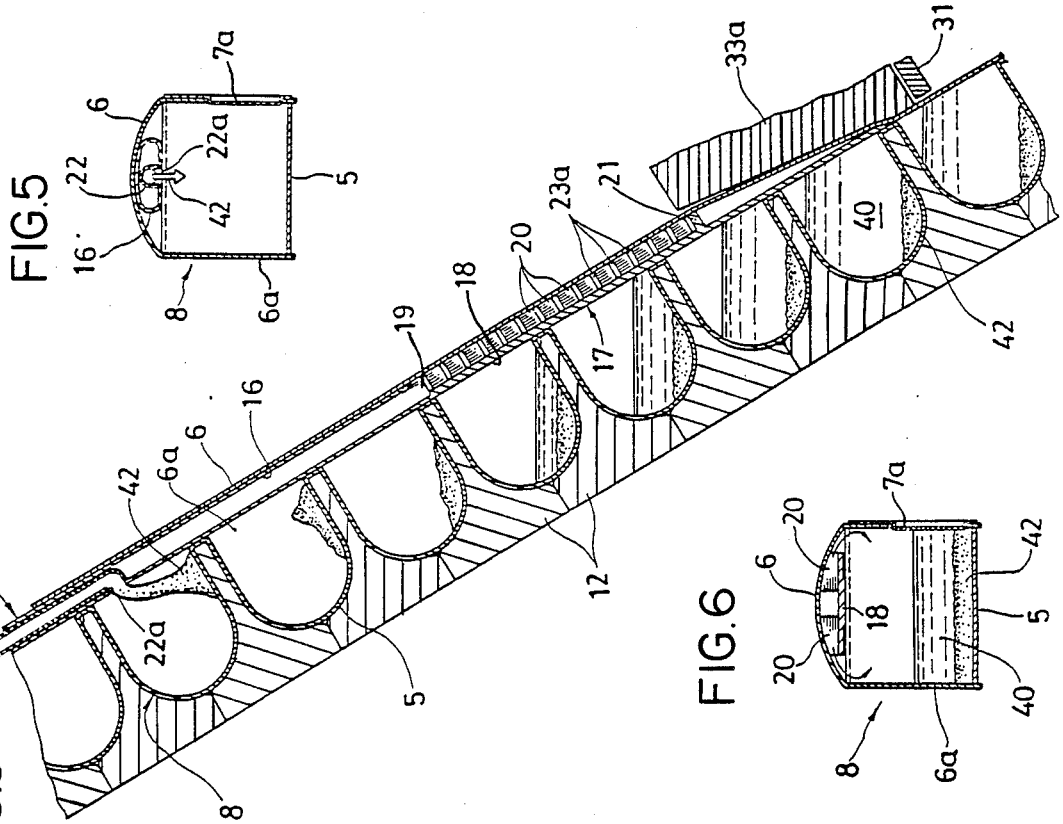
FIG.3
22
15
22a
42
6a
6
16
19
18
20
23a
21
33a
31
17
12
5
8
40
42
FIG.5
7a
6
22
22a
42
16
5
8
6a
FIG.6
7a
20
6
18
20
42
5
40
8
6a

FILLER PIPE FOR A PACKING MACHINE

BACKGROUND OF THE INVENTION

1. Field of the Invention

The present invention relates to a filler pipe for a packing machine for use in consecutively filling a traveling and continuous series of connected packing container blanks. More specifically, it relates to filling packing container blanks of two joined webs with a liquid product, such as yogurt, and a separate jam product and then sealing the packing container blank.

2. Prior Art

Conventionally, rectangular parallelepiped "brick-type" packing containers with triangular tops are widely used for packing liquid food products. In addition, packing containers for which the filler pipe described herein was designed, i.e., those formed of two joined webs in order to minimize the amount of packing container material required, have come into use. These packing containers are used for packing homogeneous liquids such as milk, juice, or yogurt, and the filling pipes used by the packing machines for each type of container are constructed to fill one container at a time.

The above-described packing containers could be filled with only one type of liquid food product. They could be filled with two types of liquid food products only by mixing the two types, thereby in actuality forming one homogeneous liquid food product such as yogurt mixed with jam or fruit particles. Two liquid food products could not be filled in a separated condition.

SUMMARY OF THE INVENTION

The present invention, therefore, has as its principal object the provision of a filling pipe capable of filling packing containers which are formed of at least two webs with a liquid product, such as yogurt, and a jam product in a separated condition, and sealing the packing containers, for use in a packing machine.

In order to fill a traveling and continuous series of connected packing container blanks, which are each formed of at least two webs with a liquid product and separate jam product, the invention comprises (1) a nozzle with multiple filling paths, each of which passes liquid to at least one of the packing container blanks; (2) a flat-shaped first delivery pipe connected to the end of the nozzle to deliver the liquid product to it; and (3) a second delivery pipe smaller in diameter than the first delivery pipe opening downward and positioned parallel to, and either inside of or on the outer lateral wall of the first delivery pipe at a predetermined distance above the junction of the first delivery pipe and the nozzle so as to pass the jam product to any of the packing container blanks.

The filler pipe of the present invention serves to dispense and charge smoothly and uniformly a liquid product into packing container blanks by means of a nozzle which is formed so that each of the multiple filling paths, which serve as the outlet for the liquid product, passes the latter to at least one of the packing container blanks. Prior to this charging action, however, a predetermined amount of jam product is charged into each of the packing container blanks. Because the liquid product is charged onto the top surface of the jam product, which is settled on the inner wall of the packing container blank, the liquid product does not mix with the jam product, thereby enabling both products to remain in a separated condition and to preserve the flavors particular to each.

BRIEF DESCRIPTION OF THE DRAWINGS

The drawings show several views of the present invention in its preferred embodiment.

FIG. 1 is a plan view of the dispensing end of a filler pipe of the present invention.

FIG. 2 is a drawing of the back of FIG. 1 and shows the opening for jam product injection.

FIG. 3 is a cross section down the center of the filler pipe showing the filler pipe in operation in the packing machine shown in FIG. 4.

FIG. 5 is a cross section viewed along V—V of the filler pipe of FIG. 1, showing the relationship with a packing container blank.

FIG. 6 is a cross section viewed along VI—VI of the filler pipe of FIG. 1 showing the relationship with a packing container blank as it is being charged.

DETAILED DESCRIPTION OF THE INVENTION

The invention will now be described with reference to the attached drawings.

FIG. 1 is a plan view showing the main portion of the dn* of a filler pipe of the present invention, and FIG. 2 is a rear view of FIG. 1 showing an outlet for charging a jam product. The filler pipe is used in the section of a packing machine which forms and fills packing containers, as shown in FIG. 4.

Figure 4:
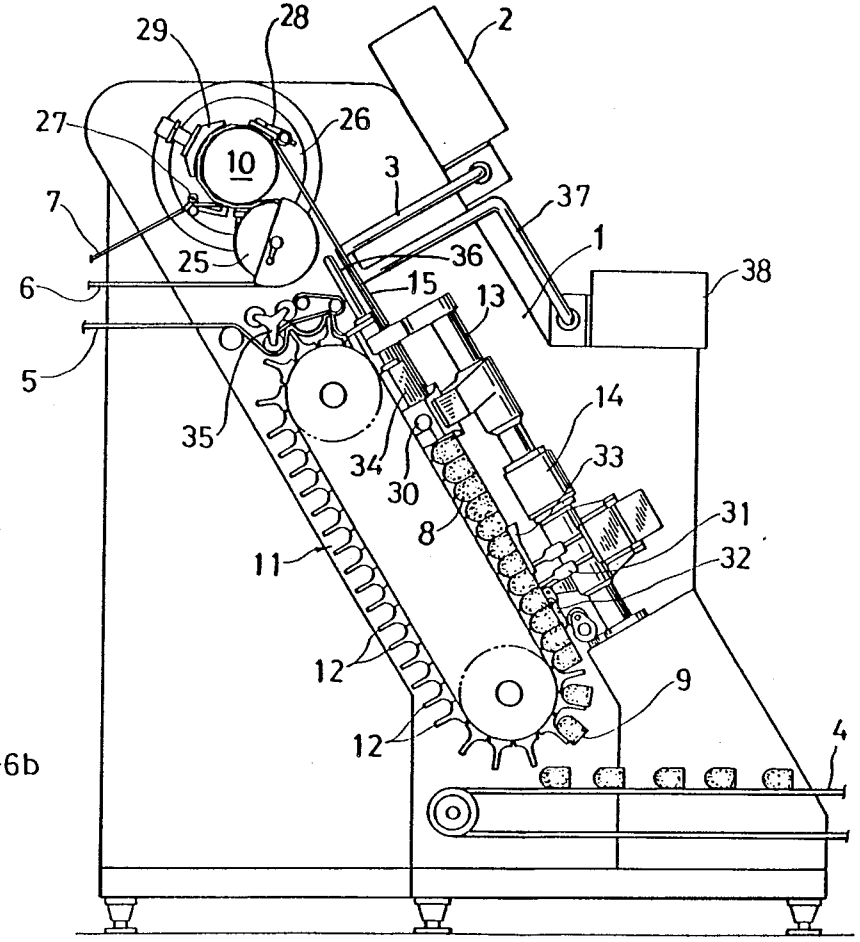
FIG. 4 is a side view of the main body of a packing machine equipped with a filler pipe of the present invention and containing charging and packing sections.

With reference to FIG. 4, a packing machine frame 1 is equipped with a filler pipe of the present invention. A pair of packing material webs 5 and 6 for use in forming the main body of a container, and a homogeneous plastic piece 7 for use as a removable lid 7*a* (FIG. 7) are introduced from storage rolls held by multiple, so-called roller stands belonging to a packing material section on the left side (not illustrated) of FIG. 4. The pair of packing material webs 5 and 6 are, for example, extruded foam plastic webs of polystyrene material coated on both sides with a layer of homogeneous polystyrene. The packing material webs 5 and 6 are, for example, extruded foam plastic webs of polystyrene* material coated on both sides with a layer of homogeneous polystyrene. The packing material webs 5 and 6 and the plastic piece 7 are formed into a series of packing container blanks, into which a liquid product and jam product are charged.

Figure 7:
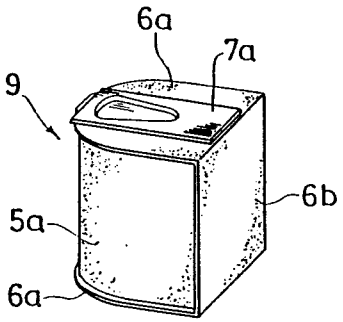
FIG. 7 is a pictorial view of the packing container produced by the packing machine of FIG. 4.

As shown in FIG. 7, an arc-shaped side wall 5*a* for the packing container unit 9 is formed fromm the first packing material web 5, top and bottom walls 6*a* and a flat side wall 6*b* are formed from the second packing material web 6, and a lid/pouring spout 7*a* is formed fromm a plastic piece 7.

Referring again to FIG. 4, rotary drum 10 is supported on frame 1 of the packing machine, and the packing material web 6 is introduced by a guide roller 25 onto the rotary drum 10 and processed at a station along the margin surrounding the drum. Frame 1 has a molding mechanism 11 to form the packing material web 5. The mechanism 11 has a movable mold part 12 attached to an endless chain, and the mold part moves clockwise at a constant speed. A specified flow rate of a liquid product, such as yogurt, to be filled is fed from a level tank (not illustrated) by a measuring pump 2 to the filler pipe 15 via a feeder pipe 3. A specified flow rate of the jam product to be filled with the liquid product is fed from a separate level tank (not illustrated) by a separate measuring pump 38 through a feeder pipe 37 and supplied at the bottom of the above mentioned feeder pipe 3 to the second delivery pipe 22 for the jam product. Delivery pipe 22 is positioned on the longitudinal centerline of the first delivery pipe 16 (See FIG. 1) to be discussed later, which together comprise the filler pipe 15. The yogurt or other liquid product and the jam product flow to and are charged into continuously moving packing container blanks 8. A column 13 making a reciprocating motion on a slide bearing 14 attached to the frame has a tuck-in device 30, a sealing device 31, and a web-cutting device 32. All these devices move with column 13 in the abovementioned reciprocating motion. The column is arranged to move together with these devices when the mold part 12 is moving downward and to move faster than these devices when the mold part 12 is moving upward to return to its original position. A mold device 33 for the central area of web 6 is provided before the sealing device 31. The filler pipe 15 connected to the lower ends of feeder pipes 3 and 37 is brought into contact with the lower surface of the continuously moving web 6 on the upper side and extends obliquely downward to a specified position. A detailed description of filler pipe 15 will be presented later.

Still referring to FIG. 4, a packing machine equipped with filler pipe 15 of the present invention operates as follows:

A controlled amount of the creased first packing material web 5 is rolled out form the storage roll at a packing material section (not illustrated) at the left of the packing machine, heated by a heating device (not shown), and brought into contact with a mold part 12 by mold device 35, folded to form an endless band of U-shaped parts, and actually moved downward by mold device 35 into molding mechanism 11. The second packing material web 6 is also rolled out from a storage roll in the packing material section (not illustrated) in the same manner as described above, made to pass over a guide roller 25, and placed onto feeder drum 10. An oscillation plate 26, which is an outside rim of the feeder drum 10 rotating at a constant speed, has attached to it processing stations, such as a drill/lid strip support 27, a molding/cutting device 28, and a heater 29, and is driven around the drum 10. As web 6 passes processing stations 27, 28 and 29 via drum 10, a pouring spout is drilled, the lid strip is attached over the pouring spout, web 6 is heated, any possible thermoforming is performed on it, and it is cut crosswise to a desired length at the margins. A homogeneous plastic piece 7 is rolled out from a storage roll (not illustrated), held on the pouring spout in the web by lid strip support 27, securely attached to web 6 so that the pouring spout is covered by the strip, and the lid portion is cut free from the plastic piece 7. The edges of web 6 with the pouring spout and opening device (lid) are cut so as to form a series of tongue pieces protruding on both sides of a length approximately equal to the height of mold part 12. Web 6 is moved forward by feeder drum 10 at exactly the same speed as mold part 12, its central section is positioned on top of mold part 12, and the web edges, cut to the shape of tongues or ears, protrude from the mold part 12. Slots in the web, through the action of a speed governor (not illustrated), are moved forward such that they are positioned at right angles to the lateral flange of mold part 12, i.e., the partition wall.

While web 6 is moved forward together with mold part 12, column 13 reaches its upper position and starts to move downward together with mold part 12. Column 13 has a heater that can be connected to air sources via pipe 36, high-temperature air is blown by the heater against the edges of web 6, i.e., against the lower face of the tongue pieces, the plastic material is softened, and it is activated due to the tight sealing. High-temperature air is also blown against the edges of web 5 exposed at the sides of mold part 12. At the same time that the heater 34 is heating the areas of webs 5 and 6 to be sealed, the protruding part of web 6, i.e., the lower piece which has already been heated during the previously mentioned movement of column 13, is bent by the flap of tuck-in device 30 and pressed against the edges of the abovementioned U-shaped ends of web 5. These superimposed web parts are thus fused together to form a mechanically durable, effective seal, which is stabilized because the sealed part is cooled while the tuck-in device 30 is engaged with the folded area of web 6. After webs 5 and 6 are laterally sealed to each other as described above, contents are supplied through filler pipe 15. The filler pipe 15 is positioned under second web 6 and on top of mold part 12. The space formed beneath second web 6 constitutes a sort of partitioned area which is filled with the predetermined contents.

Webs 5 and 6 then pass through a molder 33 and the center of web 6 is flattened. The above mentioned space is sealed by a sealer 31 into a sealed unit so that second web 6 is sealed to the portion of first web 5 on the top of the erect portion of mold part 12. Sealer 31 is also attached to column 13 and makes a reciprocating motion following the column. The sealing process is completed while column 13 moves downward together with mold part 12. Formed and sealed packing containers are cut free from each other by a cutter 32 at a sealed section formed by sealer 31. The filled, sealed, cut and separated packing containers 9 are then transferred from the lower end of the endless-chain mold part 12 to a conveyor 4 for transfer to the next process.

A filler pipe of the present invention, i.e., a filler pipe 15 for charging a liquid product and jam product separately and in a separated condition, will now be described in detail.

FIG. 3 shows a cross section of a portion of mold part 12 positioned on a mold chain, the end of filler pipe 15 having a nozzle 17, a small diameter second delivery pipe 22 for charging jam, packing container blanks 8 consisting of two webs 5 and 6, a movable molder **33*a* and a sealer 31. Filling pipe 15 consists of a first delivery pipe 16 with a flat cross section, a nozzle 17 connected to the first delivery pipe 16, and a second delivery pipe 22 to feed jam product of smaller diameter than the first delivery pipe 16. Pipe 22 opens downward and is positioned parallel to and on the longitudinal centerline of the first delivery pipe 16 at a predetermined distance above the junction of first delivery pipe 16 and nozzle 17**.

Referring to FIGS. 1, 2 and 3, nozzle 17 is formed from a long, thin substrate 18 made into a rectangular shape narrower than the height of wall **6*b* of the packing container to be produced (FIG. 7) and at least as long as two of the packing containers. Nozzle 17 is attached to the end of delivery pipe 16 so that the bottom surface of substrate 18 is a direct continuation of the bottom flat surface of the delivery pipe 16. The orifice 19 of the first delivery pipe 16 opens to the top of the substrate 18 at the junction between the first delivery pipe 16 and the substrate 18. A transverse wall 21***a* connected to orifice 19 is provided at the upstream end of guide blocks 20 to be described later, linking the left and right rows of guide blocks. Multiple guide blocks 20 forming paths to induce the liquid product 40 to flow to the left and right are provided on the upper surface of substrate 18. Guide blocks 20 are triangular when viewed from the top, and are arranged in symmetrical pairs along the longitudinal axis of substrate 18 so that one wall 20*a* of each guide block 20 faces upstream, the outer edge of each guide block 20 extends to the edge of substrate 18, and the inner edges gradually extend toward the center upstream to downstream, from both sides of the width of orifice 19. Guide blocks 20 are set at intervals to form filling paths 23 between orifice 19 and blocking wall 21 to stop liquid flow providing at a specified location downstream and lengthwise down substrate 18 from orifice 19. Because the gap between symmetrically positioned guide block 20 pairs is widest at the edge of substrate 18 connected to delivery pipe 16 and smallest on the opposite or downstream end of substrate 18, the liquid flow section in the center of substrate 18 is actually shaped like a long slender triangle.

FIG. 6 shows how the upper surfaces of guide blocks 20 arranged in two paired rows between the upstream and downstream blocking walls are formed to fit the inner surface of the higher arc-shaped central section of web 6, which links tongue pieces 6a of web 6 moving downward.

Referring again to FIGS. 1, 2 and 3, flat panel 24 of specified length, which is wider than substrate 18, attached as an extension of the substrate 18 on the downstream end of substrate 18, i.e., the end opposite first delivery pipe 16, and connected to nozzle 17 and opposite the downstream blocking wall 21, is attached with a common bottom surface to that of substrate 18 so that proper head space is formed and maintained when filling packing container blanks 8 with liquid product 40. Liquid product 40 passes through orifice 19 via first delivery pipe 16 and flows through the abovementioned long narrow triangular liquid flow section between substrate 18 and web 6 moving in contact with the top surfaces of the guide blocks 20 on the substrate 18. Liquid product 40 then passes out through the filling paths 23 via the any narrow filling outlets 23*a* between the guide blocks 20 so that any air inflow is prevented and air bubbles in the liquid product are removed, and is separated and charged via the wide discharge ports into packing container blanks 8.

Pressure drop in the downstream liquid product is actually compensated for by the triangular shape of the liquid flow section, and liquid product 40 is forced out evenly from the multiple filling paths 23 so that it contacts the tongue pieces 6a and charged the U-shaped pieces (FIG. 6). Because the jam product 42 is separately charged into the containers before the liquid product 40 is charged, the opening 22*a* of second delivery pipe 22 to supply jam is positioned in the bottom of first delivery pipe 16 at a location a specified distance, i.e., a certain number of container lengths (determined by the viscosity of the jam) upstream from orifice 19 at the junction between first delivery pipe 16 and nozzle 17.

As described previously (FIG. 4), a specified flow rate of jam is supplied to second delivery pipe 22 by measuring pump 38 from a level tank (not illustrated) via a feeder pipe 37, and a small, specified amount of the jam flows through the opening 22*a* into each of the continuously moving packing container blanks 8. After the packing container blanks 8 have moved a certain distance, yogurt or other liquid product 40 flows from nozzle 17 onto the top of jam product 42 previously charged into the packing container blanks 8 (See FIG. 6). Nozzle 17 is at least as long as two continuous packing container blanks 8, and the packing container blanks that move past it are gradually filled with the liquid product 40 and charging is completed with the jam product 42 on the bottom and the yogurt or other liquid product 40 on the bottom, maintaining a separated condition without intermixing.

After charging, the center of web 6 is leveled by molder 33*a* and sealed by sealer 31. During this interval, the sealed containers pass a flat panel 24 and, because charging does not take place, proper head space is ensured during sealing.

In the above embodiment the filling paths 23 from both sides of nozzle 17 are formed by using multiple triangular guide blocks 20 on substrate 18. This application is, however, not limited to these triangular guide blocks, i.e., other shapes could be used, such as straight, latter-shaped, or arc-shaped. Multiple holes could be opened in flat, prismoidial distribution spaced connected to first delivery pipe 16 and several horizontal walls formed to guide the liquid product 40 to both sides, or other forms could be devised to suit the liquid material to be charged.

Furthermore, although in the above embodiment the second delivery pipe 22 is positioned inside the first delivery pipe 16, the second delivery pipe 22 could be positioned on the outer lateral wall of first delivery pipe 16.

As the above discussion clearly indicates, the present invention relates to the production of packing containers charged with a liquid food product, such as yogurt, and also a jam product, which permits charging in a separated condition without intermixing, thus preserving the individual flavors of the products and providing a superior type of product not previously available.

I claim:

1. A filler pipe for packing machine for use in filling a continuous series of connected packing container blanks with a liquid product and a separate jam product, said filler pipe comprising:

a nozzle with a plurality of filling paths with each of said plurality of filling paths adapted for passing said liquid product to at least one of said packing container blanks, said nozzle comprising an upstream end and a downstream end with two outer sides joined by an upper face and a bottom face connecting said upstream and downstream ends, with multiple guide blocks arranged in symmetrical pairs disposed within and along the longitudinal axis of said nozzle so that one wall of each of said guide blocks faces an upstream direction, an outer edge of each of said guide blocks extends to an outer side of said nozzle and an inner edge of said guide blocks gradually extends toward the longitudinal axis of said nozzle, from both of the outer sides of said nozzle, said guide blocks defining filling paths formed therebetween along the longitudinal axis and on the bottom face of said nozzle and arranged between said upstream and downstream ends;

a flat shaped first delivery pipe having an upper face and a bottom face connected to the upstream end of said nozzle to deliver said liquid product to said nozzle; and a second delivery pipe smaller in diameter than said first delivery pipe and positioned parallel to and on the interior of said first delivery pipe and having an outlet opening extending through the bottom face of said first delivery pipe at a predetermined distance above the junction of said first delivery pipe and said nozzle and adapted for passing said jam product to any of the packing container blanks.

2. The filler pipe for a packing machine of claim 1 wherein said downstream end of said nozzle comprises a horizontal blocking wall which is located between said upper and lower faces of said nozzle, with the bottom surface of said blocking wall being common with the bottom face of said nozzle and the height of said blocking wall is designed to correspond to the height of the above described packing container blanks.

* * * * *